US008624691B2

(12) United States Patent
Wong

(10) Patent No.: US 8,624,691 B2
(45) Date of Patent: Jan. 7, 2014

(54) CAVITY FILTER

(75) Inventor: Kwo-Jyr Wong, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 318 days.

(21) Appl. No.: 13/110,926

(22) Filed: May 19, 2011

(65) Prior Publication Data

US 2012/0235771 A1 Sep. 20, 2012

(30) Foreign Application Priority Data

Mar. 17, 2011 (CN) ..... 2011 2 0070118 U

(51) Int. Cl.
*H01P 1/205* (2006.01)
*H01P 7/04* (2006.01)

(52) U.S. Cl.
USPC ..... 333/203; 333/223

(58) Field of Classification Search
USPC ..... 333/202, 203, 222, 223, 227, 206, 207
See application file for complete search history.

(56) References Cited

U.S. PATENT DOCUMENTS 6,466,110 B1 * 10/2002 Wulff et al. ..... 333/222

* cited by examiner

*Primary Examiner* — Benny Lee
*Assistant Examiner* — Rakesh Patel
(74) *Attorney, Agent, or Firm* — Altis Law Group, Inc.

(57) ABSTRACT

A cavity filter includes a unitarily formed piece, a cap, a cover, and a tuning adjustment screw. The unitarily formed piece includes a bottom plate portion, a resonator tube body portion formed on a center of the bottom plate portion, and a sidewall portion extending from the bottom plate portion surrounding the resonator tube body portion. The resonator tube body portion defines a resonating cavity therein. The cap is attached onto a distal end of the resonator tube body portion. The cap and the resonator tube body portion cooperatively forms a resonator tube. The cover is attached to the sidewall portion, and the cover includes a screw hole. The cover, the sidewall portion, and the bottom plate portion cooperatively forms a chamber. The tuning adjustment screw is extending through the cover, threadedly engaged in the screw hole and aligned with the resonator tube.

10 Claims, 6 Drawing Sheets

CAVITY FILTER

BACKGROUND

1. Technical Field

The present disclosure relates to cavity filters including resonator tubes.

2. Description of Related Art

Cavity filters are the basic circuitry behind a duplexer and are in a sharply tuned resonant circuit that allows only certain frequencies to pass. A typical cavity filter has one or more resonator tubes each in corporation with one tuning adjustment screw. Traditionally, the resonator tubes are fixed in the cavity filter by fixing members, such that the more resonator tubes and tuning adjustment screws, the longer it takes to assemble the cavity filter.

What is needed, therefore, is a cavity filter capable of being assembled quickly.

BRIEF DESCRIPTION OF THE DRAWINGS

Many aspects of the present cavity filter can be better understood with reference to the following drawings. The components in the drawings are not necessarily drawn to scale, the emphasis instead being placed upon clearly illustrating the principles of the present resonator tube and cavity filter including the resonator tube. Moreover, in the drawings, like reference numerals designate corresponding parts throughout the views.

DETAILED DESCRIPTION

Figure 1:
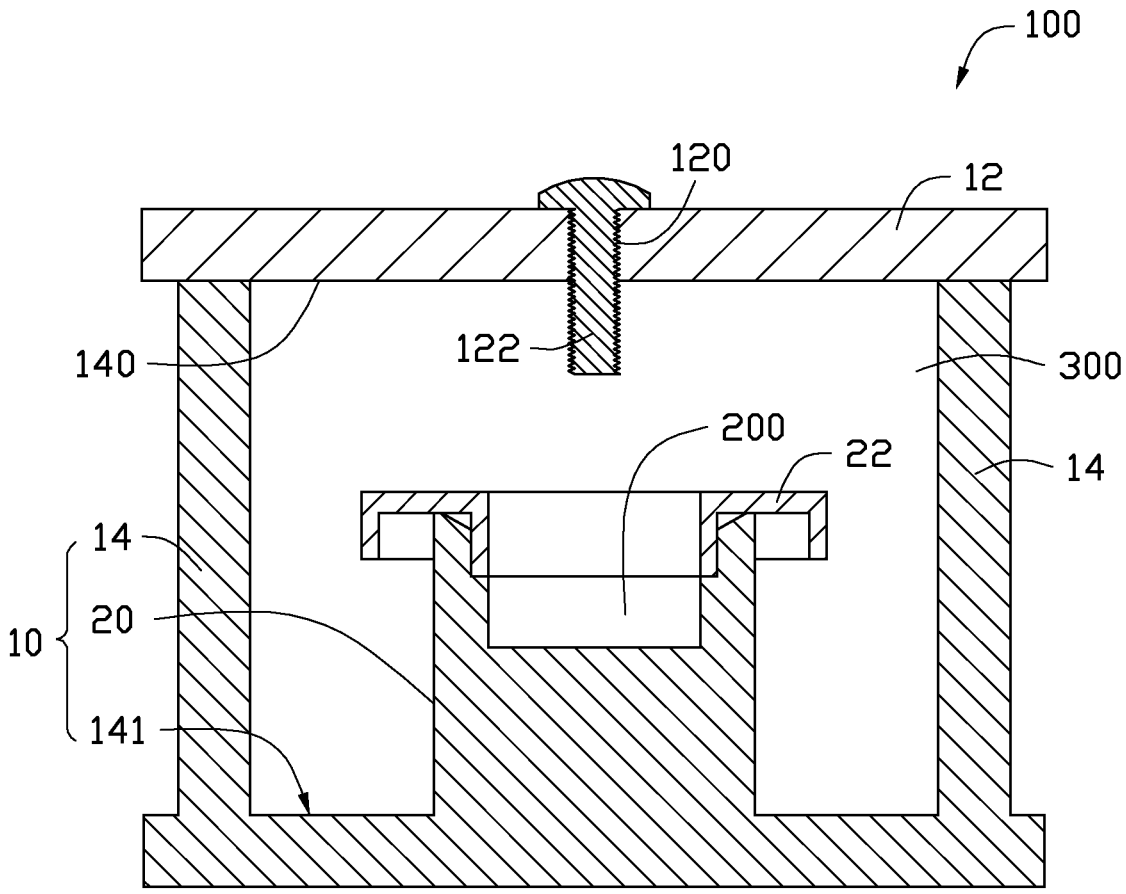
FIG. 1 is a sectional view of a cavity filter in accordance with a first embodiment, the cavity filter including a resonator tube.
Figure 2:
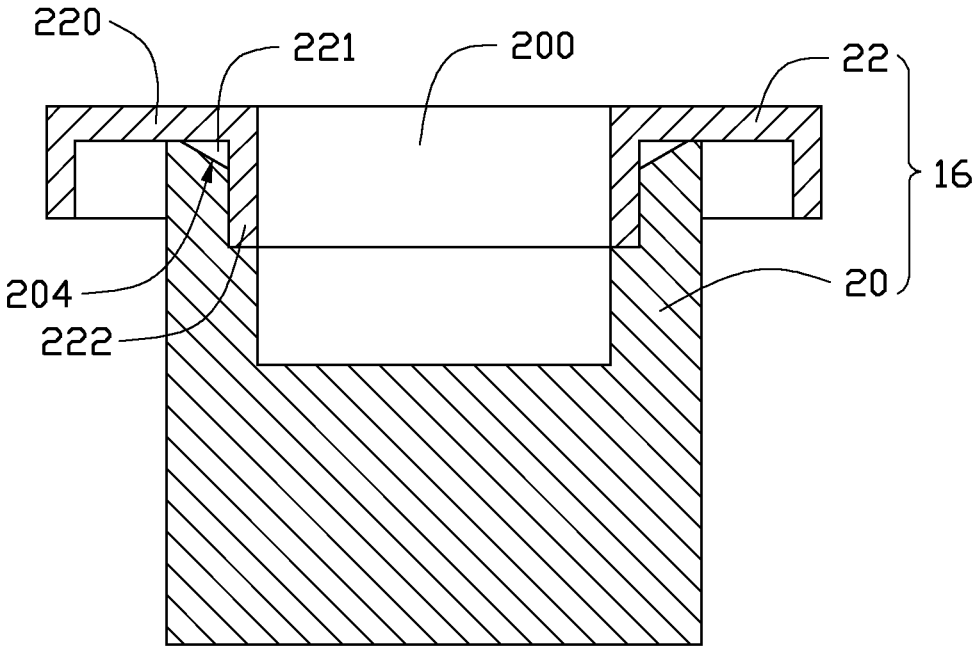
FIG. 2 shows the resonator tube of FIG. 1.

Referring to FIGS. 1 and 2, a cavity filter 100 provided by a first exemplary embodiment includes a unitarily formed piece 10, a cover 12, a cap 22, and a tuning adjustment screw 122.

The unitarily formed piece 10 is made by casting or molding operation. The unitarily formed piece 10 includes a bottom plate portion 141, a resonator tube body portion 20 formed on a center of the bottom plate portion 141, and a sidewall portion 14 extending from the bottom plate portion 141 surrounding the resonator tube body portion 20.

The resonator tube body portion 20 defines a resonating cavity 200 therein. The cap 22 is attached onto a distal end, that is, the top end of the resonator tube body portion 20. The cap 22 and the resonator tube body portion 20 cooperatively form a resonator tube 16. The size and shape of the cap 22 can be varied to effect the frequency of the cavity filter 100.

The sidewall portion 14 is substantially cylindrical in shape. The sidewall portion 14 has a top opening 140. The cover 12 is attached onto the sidewall portion 14 and shade the top opening 140. The cover 12, the sidewall portion 14, and the bottom plate portion 141 cooperatively form a chamber 300. The chamber 300 communicates with the resonating cavity 200.

The tuning adjustment screw 122 extends through the cover 12 by a screw hole 120 formed in a central area of the cover 12. The tuning adjustment screw 122 is threadedly engaged in the screw hole 120 and aligned with the resonator tube 16. The tuning adjustment screw 122 is formed from a conductive material, such as brass, for example. There may be a number of resonator tubes 16 and a number of corresponding tuning adjustment screws in one cavity filter.

Figure 3:
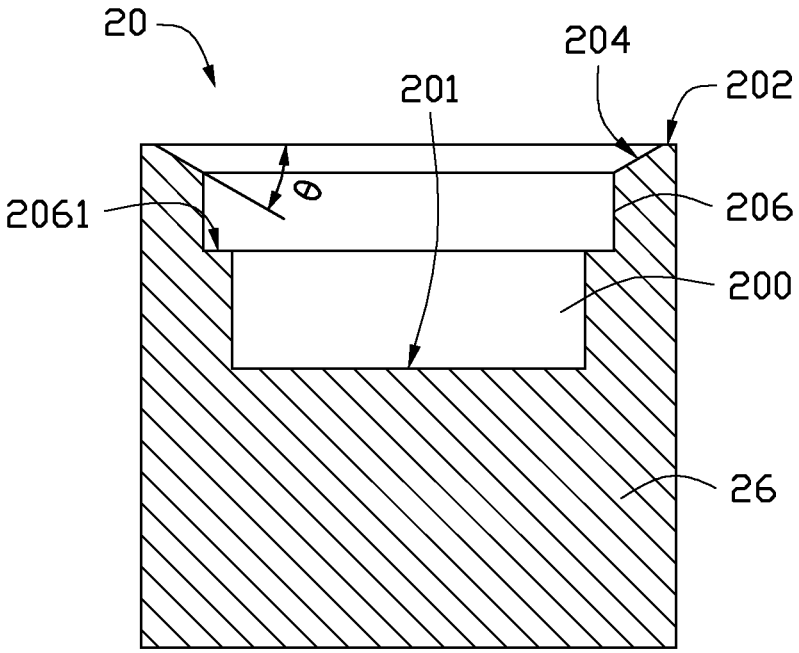
FIG. 3 shows a support and a resonator tube body portion of the cavity filter of FIG. 1.

Referring to FIGS. 1 and 3, the resonator tube body portion 20 includes a top end surface 202 at the distal end, an inner annular step surface 206 located in the resonating cavity 200, and an annular beveled surface 204 connecting the top end surface 202 and the inner annular step surface 206.

The top end surface 202 is a flat surface parallel to the bottom plate portion 141. The beveled surface 204 inclines to the interior of the resonating cavity 200 about θ degrees. θ is an acute angle. One step part 2061 of the step surface 206 is parallel to the bottom plate portion 141 and configured to support an inner tube 222 (shown in FIG. 4) of the cap 22. The length of the step part 2061 is equal to that of the inner tube 222.

There is a bottom surface 201 located on the center of the resonator tube body portion 20. The resonator tube body portion 20 also includes a support 26 below the bottom surface 201 and over the bottom plate portion 141. The support 26 is solid and free of apertures, thus the probability of a third-order harmonic distortion is lowered.

Figure 4:
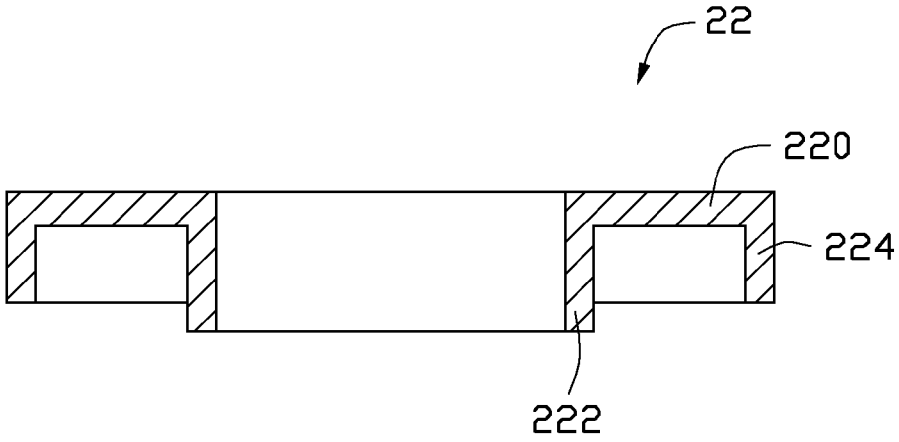
FIG. 4 shows a cap of the cavity filter of FIG. 1.
Figure 5:
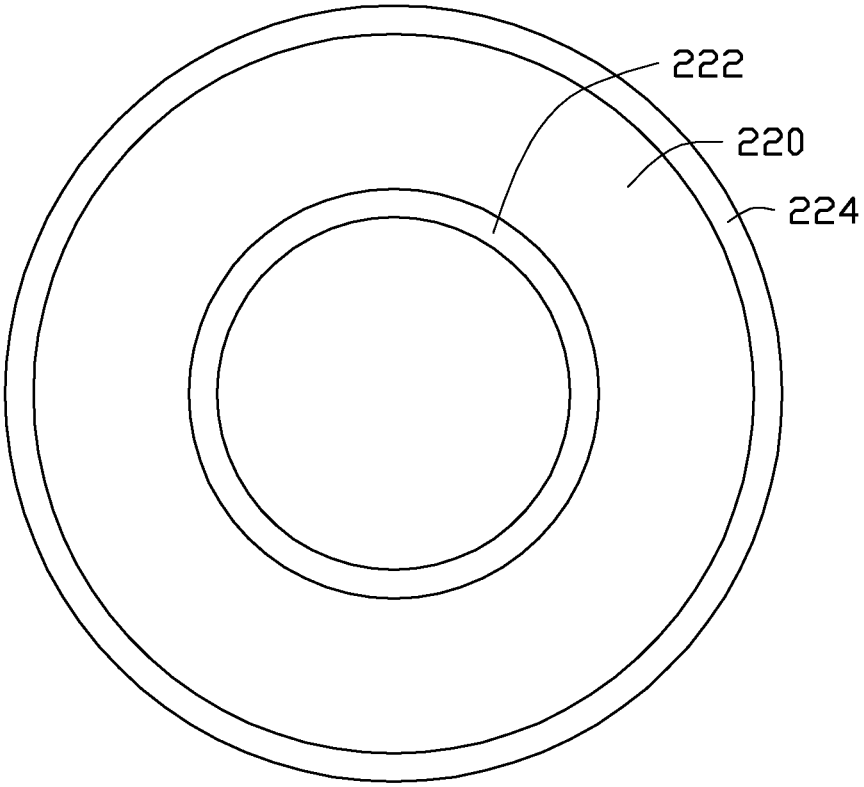
FIG. 5 is a bottom plan view of the cap of FIG. 4.

The detail structure of the cap 22 is mainly shown in FIGS. 4 and 5. The cap 22 is hollow in its central part. The cap 22 includes an inner tube 222, an outer tube 224 surrounding the inner tube 222, and a ring-shaped flange 220 extending outwardly from the inner tube 222 to the outer tube 224. The inner tube 222 is inserted in the resonator tube body portion 20 and abutting the step surface 206 (as shown in FIGS. 1 and 2).

Figure 6:
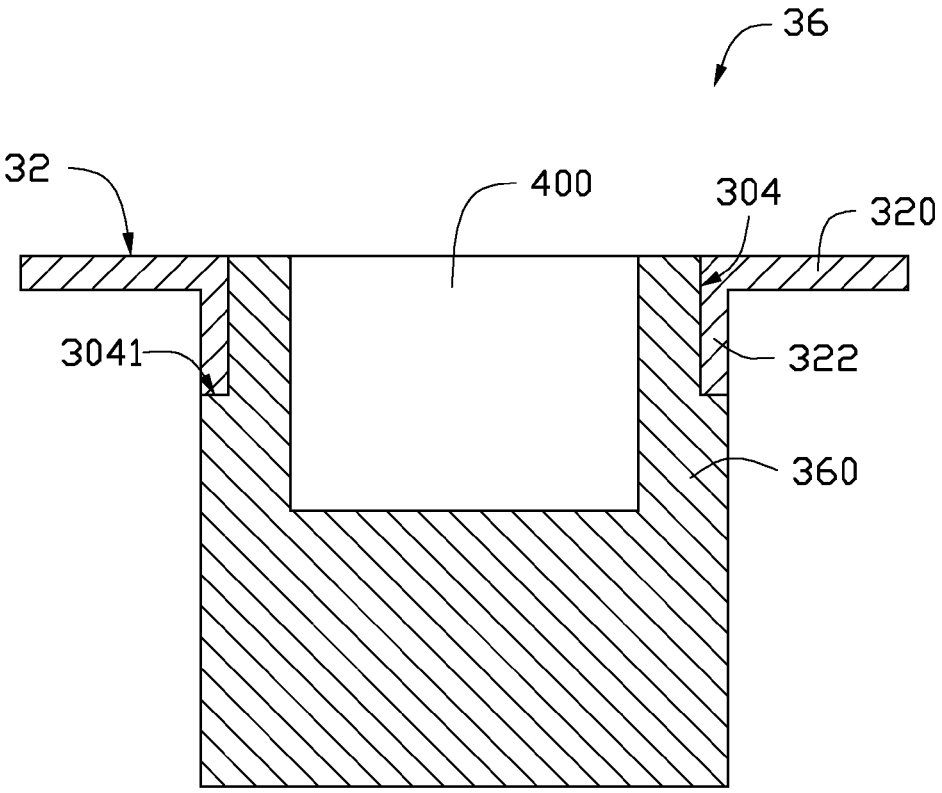
FIG. 6 shows an alternative configuration of the resonator tube.

Referring to FIG. 2, the ring-shaped flange 220 is attached on the distal end of the resonator tube body portion 20. Because the cap 22 is manufactured by a method of continuous stamping, there may be some protrusions (now shown) at the corner of the inner tube 222 and the ring-shaped flange 220. A gap 221 between the ring-shaped flange 220 and the beveled surface 204 will be helpful to these protrusions when the cap 22 is located on the resonator tube body portion 20. Thus, the cap 22 is capable of abutting the resonator tube body portion 20 firmly, and a third-order harmonic distortion is lowered Refer to FIG. 6, an alternative resonator tube 36 includes an annual outer step surface 304 located outside the resonating cavity 400. The cap 32 includes a tube 322 and a ring-shaped flange 320 extending outwardly from the tube 322. The tube 322 is surrounding the resonator tube body portion 360 and abutting the outer step surface 304. The ring-shaped flange 320 is not lower than the resonator tube body portion 360. The length of the tube 322 is equal to that of the step part 3041 of the outer step surface 304.

The resonator tube (except the cap), the bottom plate portion, and the sidewall portion are formed unitarily, therefore, the location of the resonator tube is accurate according to the predetermined design, and does not need to be moved or adjusted. The cap also does not need fixing members to be matched with the resonator tube body portion. In all, the time for producing or assembling the cavity filter is minimized.

It is understood that the above-described embodiments are intended to illustrate rather than limit the disclosure. Variations may be made to the embodiments without departing from the spirit of the disclosure. Accordingly, it is appropriate that the appended claims be construed broadly and in a manner consistent with the scope of the disclosure.

What is claimed is:

1. A cavity filter, comprising:

a unitarily formed piece comprising a bottom plate portion, a resonator tube body portion formed on a center of the bottom plate portion, and a sidewall portion extending from the bottom plate portion surrounding the resonator tube body portion, the resonator tube body portion defining a resonating cavity therein;

a cap attached onto a distal end of the resonator tube body portion, the cap and the resonator tube body portion cooperatively forming a resonator tube;

a cover attached to the sidewall portion, and the cover comprising a screw hole; the cover, the sidewall portion, and the bottom plate portion cooperatively forming a chamber; and a tuning adjustment screw extending through the cover, threadedly engaged in the screw hole and aligned with the resonator tube, wherein the resonator tube body portion comprises an inner annular step surface located in the resonating cavity, the cap comprises an inner tube, an outer tube surrounding the inner tube, and a ring-shaped flange extending outwardly from the inner tube to the outer tube, the inner tube is inserted in the resonator tube body portion and abuts the inner annular step surface, the ring-shaped flange is attached on the distal end of the resonator tube body portion.

2. The cavity filter of claim 1, wherein the sidewall portion is substantially cylindrical.

3. The cavity filter of claim 1, wherein the distal end of the resonator tube body portion comprises an annular beveled surface, a gap being formed between the ring-shaped flange and the annular beveled surface.

4. The cavity filter of claim 1, wherein the inner annular step surface comprises a step part substantially parallel to the bottom plate portion to support the cap.

5. The cavity filter of claim 1, wherein the resonating cavity communicates with the chamber.

6. The cavity filter of claim 1, wherein the unitarily formed piece comprises a support connected between the bottom plate portion and the resonator tube body portion, the support is solid and free of apertures.

7. A cavity filter, comprising:

a unitarily formed piece comprising a bottom plate portion, a resonator tube body portion formed on a center of the bottom plate portion, and a sidewall portion extending from the bottom plate portion surrounding the resonator tube body portion, the resonator tube body portion defining a resonating cavity therein;

a cap attached onto a distal end of the resonator tube body portion, the cap and the resonator tube body portion cooperatively forming a resonator tube;

a cover attached to the sidewall portion, and the cover comprising a screw hole; the cover, the sidewall portion, and the bottom plate portion cooperatively forming a chamber; and a tuning adjustment screw extending through the cover, threadedly engaged in the screw hole and aligned with the resonator tube, wherein the resonator tube body portion comprises an outer step surface located outside the resonating cavity, the cap comprises a tube and a ring-shaped flange extending outwardly from the tube, the tube surrounds the resonator tube body portion and abuts the outer step surface.

8. The cavity filter of claim 7, wherein the unitarily formed piece comprises a support connected between the bottom plate portion and the resonator tube body portion, the support is solid and free of apertures.

9. The cavity filter of claim 7, wherein the resonating cavity communicates with the chamber.

10. The cavity filter of claim 7, wherein the sidewall portion is substantially cylindrical.

* * * * *